US005701619A

United States Patent [19]

Ullman

[11] Patent Number: 5,701,619

[45] Date of Patent: Dec. 30, 1997

[54] STRETCHER

[76] Inventor: Johan Ullman, Johannebergsgatan 32 B, S-412 55 Göteborg, Sweden

[21] Appl. No.: 581,619

[22] PCT Filed: Jul. 21, 1994

[86] PCT No.: PCT/SE94/00702

§ 371 Date: Mar. 28, 1996

§ 102(e) Date: Mar. 28, 1996

[87] PCT Pub. No.: WO95/03026

PCT Pub. Date: Feb. 2, 1995

[30] Foreign Application Priority Data

Jul. 21, 1993 [SE] Sweden ..... 9302461

[51] Int. Cl.[6] ..... A61G 1/00; A61G 1/044; A61G 1/048

[52] U.S. Cl. ..... 5/625; 5/628; 5/953

[58] Field of Search ..... 5/625, 626, 627, 5/628, 740, 953

[56] References Cited

U.S. PATENT DOCUMENTS

| | | | |
|---|---|---|---|
| 2,350,573 | 6/1944 | Smith, Jr. et al. | 5/627 |
| 3,151,343 | 10/1964 | McCormick | 5/627 |
| 4,053,957 | 10/1977 | Regan | 5/740 |
| 4,723,327 | 2/1988 | Smith . | |
| 4,922,562 | 5/1990 | Allred et al. | 5/82 R |
| 5,121,514 | 6/1992 | Rosane | 5/628 |

FOREIGN PATENT DOCUMENTS

| | | | |
|---|---|---|---|
| 0252672 | 12/1988 | European Pat. Off. | 5/628 |
| 418145 | 5/1981 | Sweden . | |
| 363126 | 8/1962 | Switzerland . | |
| WO 87/04614 | 8/1987 | WIPO . | |

*Primary Examiner*—Rodney M. Lindsey
*Assistant Examiner*—Robert G. Santos
*Attorney, Agent, or Firm*—Samuels, Gauthier, Stevens & Reppert

[57] ABSTRACT

Stretcher consisting of a piece of material (1), said material being a semi-rigid material such as cellular plastics and having recesses (10, 11) forming handgrips for being carried. Longitudinal channels (4) extend on both sides of a middle part of the material piece (1), said channels being arranged to house stiffening elements (15, 16) having a flat cross-section with substantially larger width than thickness. The width of the middle part between the channels corresponds to the width of a body plus two times half the body thickness of persons to which the stretcher is adapted, so that when the material piece is folded around a person, the channels (4) will be located on the sides of the body. The material layers (1, 5) which delimit the channels will then be located substantially vertically when the stretcher is carried by the handgrips so that the stiffening elements are maintained held with their sections on edge when the arrangement is used for transport.

4 Claims, 2 Drawing Sheets

STRETCHER

TECHNICAL FIELD

The invention relates to a stretcher for moving of injured persons, as defined in the preamble of claim 1.

PRIOR ART

The main type of stretchers which have been in use for a long time consist of an elongated frame having handles at both ends. In the frame, an element with a resting surface has been mounted, which surface is to support the one to be transported on the stretcher. The element can for example consist of a piece of cloth which has been tightly stretched in the frame or, with simpler stretchers, a piece of cloth hanging between two rods which form the side pieces of the frame. In EP B1 0 294 378 it is proposed to use a heat-insulating foam material having an integrated surface layer for the resting surface. In the first place a piece of this material is intended to form a mattress or lying underlay when resting in the field. However, it is proposed to use this underlay as an emergency stretcher by pushing rods in through holes in the piece of material and using the protruding ends of the rods as handles. Alternatively it is proposed to use the piece of material as a stretcher even without rods by using specially formed holes therein as handles. A similar lying underlay having holes for forming handgrips is also known from U.S. Pat. No. 4,067,079.

The idea of using a lying underlay as an emergency stretcher, when being in the field and where said underlay is always taken along, has advantages per se. The lying underlay is usually available in an emergency situation when somebody has been injured during field service and the insulating, somewhat-rigid but at the same time resilient, material provides good comfort and at the same time also the heat insulation which is often very important for the injured person. However, disadvantages also exist. If one makes a stretcher by inserting rods into holes in the piece of material, such rods accordingly have to be acquired or taken along already. In this way, an important advantage is lost in that the stretcher can be formed only by the lying underlay, which can easily be carried and is usually also used in the field. If the carrying underlay is used only in carrying it by means of the holes at the edges, at least four bearers are required, two at each end. Even when four bearers are used, such a stretcher will be very uncomfortable since the piece of material is bowed between the carrying points and the injured person is made to assume a hunched-up position. This can be very disadvantageous and it can severely aggravate the injury if this relates to some central part of the body, for example the backbone. Even if bearers are also available for the middle part of the piece of material, this underlay will produce an uneven surface and will change its shape all the time, particularly during transport on uneven terrain. This can also be very unfavourable in respect of certain injuries.

STATEMENT OF THE INVENTION

The present invention aims at eliminating such disadvantages, so that a lying underlay or mattress of the said type can be used as a stretcher, with which a person can be transported in an out-stretched position without being in a hunched-up position or the body being subjected to continuous changes of position during transport. The need for special rods having a greater length than the length of the body is eliminated.

These advantages are obtained by the arrangement of stiffening elements having a flat cross-section which can be divided into several shorter lengths, so that they can be rolled in into the piece of material during its transport. The possibility of using such stiffening elements without any larger space requirement is obtained in that special channels for housing these elements are arranged in the piece of material.

DESCRIPTION OF THE FIGURES

One embodiment of the invention will be described below in connection with the attached drawings. These show in FIG. 1 one view of the stretcher arrangement in a spread-out condition.

PREFERRED EMBODIMENT

Figure 1:
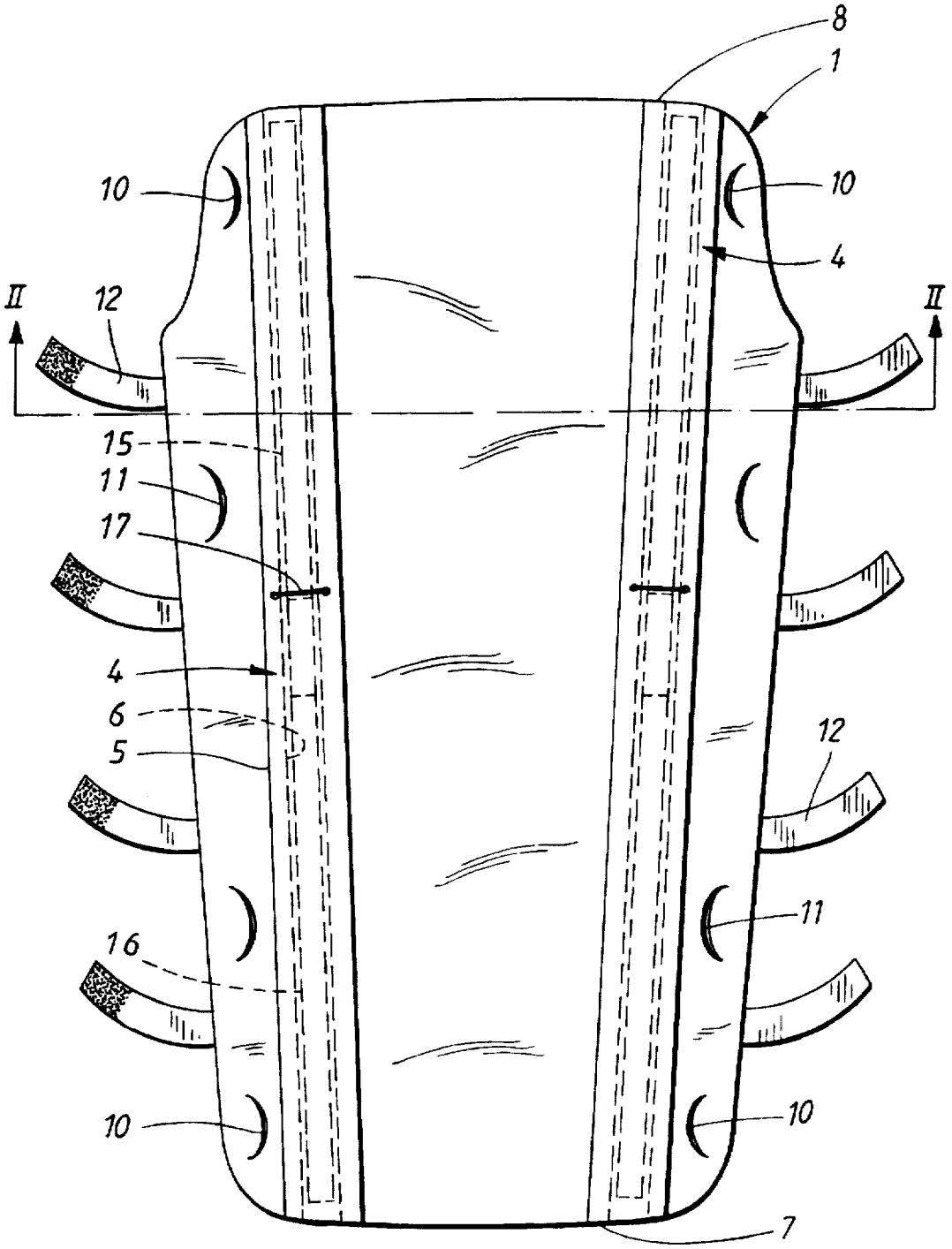

As appears from FIG. 1, the main part of the stretcher is formed by a piece of material 1. This has an upper side, which is shown in FIG. 1 and which is denoted as 2 in FIG. 2. Opposite to this is an underside 3. At least the underside must be water-impermeable since it is presumed that the stretcher might have to be put down on a damp base.

The material in the piece 1 should be semi-stiff, elastically resilient in the surface, but only insignificantly stretchable, preferably foam. It should not be absorbent and, as mentioned especially not from the underside 3. As a suitable material, cellular plastic has been mentioned, which cellular plastic should have closed cells. At the surface of the cell body, a dense surface layer should exist, suitably thicker at the underside 3 than at the upper side 2. A suitable thickness may be 5–10 mm in the foam material 1 and up to about 1 mm in the surface layers 2,3. A polymer material such as polyethylene can be suitable. Two channels 4 run along the piece of material, said channels being formed in grooves 6 on the upper side 2 of the piece of material and being covered by attached material strips 5 at the upper side, which strips are preferably made of a semi-stiff material. The strips can be sewn to the piece of material. The grooves are shown here cut in through the foam layer to the thicker surface layer on the side 3, this being a preferred embodiment.

The piece of material 1 should have a length which corresponds to the length of the body of a man, say about 2 meters. The width between the channels 4 is adapted to the width of a human body plus two times half the thickness of the body. This is the ideal adaptation which should be derived from the body measurements of persons, for whom the stretcher is primarily intended, for example adult men of normal size. Persons who strongly deviate from this norm, for example children, can however also be advantageously transported on the stretcher.

As is shown in FIG. 1, the width between the channels 4, in being adapted to the bodyshape of a human, changes along the length of the piece of material from a broader head end 8 to a smaller foot end 7. These ends may be provided with substantially semi-circular shaped cuts 10, which make it possible to insert one's hand when the stretcher is to be carried. Such cuts can also be made along the side edges so as to form further carrying handles 11. Along the side edges a number of straps 12 are arranged which are provided with tensioning devices so that they can be tightened in pairs. Here a connection by means of velcro bands is indicated, but clasps can alternatively be used.

Figure 2:
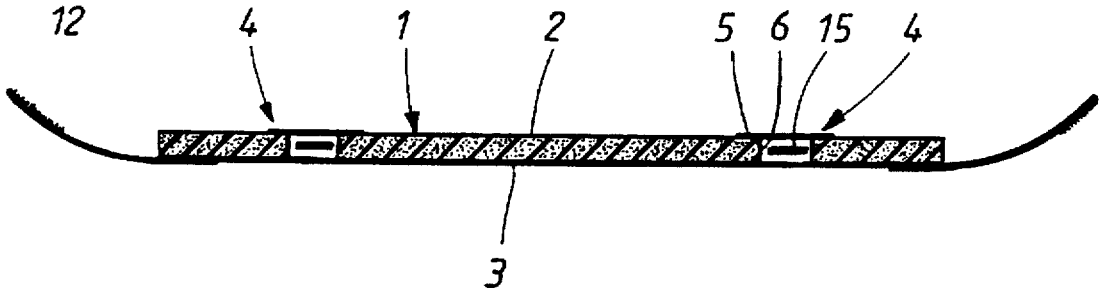
FIG. 2 an end view of the stretcher arrangement as in FIG. 1.
Figure 3:
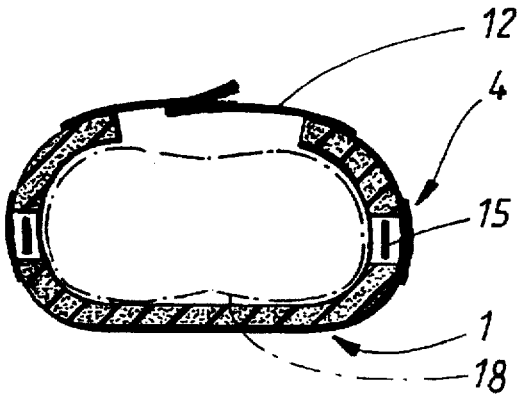
FIG. 3 the stretcher arrangement in the condition of use when a person is to be transported therewith.

Stiffening elements 15, 16 can be housed in the channels 4 (see FIGS. 2 and 3). These can suitably be made of glass-fibre reinforced plastics and they should have a long and narrow cross-section; they shall accordingly have the shape of flat rods. When in place in the channels 4, they should ensure that the stretcher is kept rigid so that the channels and hence the middle part of the piece of material (the bottom of the stretcher) form a straight line in its longitudinal direction. The effective length of the element should thus be approximately the same as the length of the material piece 1. However, to make them more easily transportable, the stiffening elements may be divided into shorter lengths, if these are laid in an overlapping relationship. As is indicated in FIG. 1 they may for example be divided into two lengths 15 and 16 together being about 20 cm longer than the channels 4. When in place in the channels 4, the element sections are laid as shown in FIG. 1, overlapping each other by a certain distance which is decided based on the combined length of the sections compared to the length of the channels. A suitable attachment of the stiffening elements is that one of the parts, here denoted 15, is inserted in its channel from the head end. The other part 16 is inserted into an opening 17 (FIG. 1) in the band 5 approximately midway between the head and foot ends.

The reason that the stiffening elements 15, 16 are made flat is that they should occupy less space, but also for the reason that if they are lying in the channels 4 and the stretcher device is used spread-out as a lying underlay, they should not form noticeable protrusions on the upper side. In order that they can actually function as stiffening elements they must, when being used, be kept on their ends so that the higher bending stiffness of the width section is made use of.

How this is obtained is shown in FIG. 3. The material piece 1 is here folded for transport of a person, the body section of which is indicated with a chain-dotted line 18. Since the width between the channels 4 is the width of the body plus approximately two times half of the body-depth the channels 4 will be located at the parts which extend along the sides of the body of the person and which are thereby approximately vertical when seen in cross-section if the stretcher is carried with the handgrips 10 and possibly also 11. The parts of the material piece where the channels are located will also receive a certain support in their upright positions by the body of the person which is carried. For persons having body measurements which greatly deviate from the ones to which the dimensions of the stretcher have been adapted, the channels 4 can come higher up than shown in FIG. 3 for small body sizes. When however the stretcher is to be carried by the handgrips 10 and possibly 11 which are located above the channels in the carrying position, the stiffening elements 15, 16 will nevertheless be standing on their edges in the channels.

When being used, the outer parts outside the channels 4 can be bent in over the body of the person towards its upper side and the edges can be connected by the straps 12. In this way the person is protected from falling out if the stretcher for example were to be lifted at a steep angle or vertically, and due to its tube shape it will have a more rigid form.

It is important that the channels 4 are well adapted to the stiffening elements 15, 16 so that they do not have enough space to lie on their sides but are securely held on their edges when the stretcher is carried. This is of course especially important if the stiffening element has been divided into sections, in the joints of which the element should be able to bend if its overlapping parts are not held well-fixed in their respective channels.

I claim:

1. A stretcher comprising:

a sheet of a semi-rigid cellular material and having homogeneous surface layers;

a plurality of hand grips in the form of recesses arranged along the edges of the sheet for carrying; and a pair of longitudinal channels running along each side of a middle portion of said sheet, said channels being adapted to receive stiffening elements having a flat cross-section with a substantially larger width than thickness, said middle portion having such a width so as to envelop a portion of the body of a person lying in said middle portion upon said stretcher being lifted by said hand grips, whereby said channels are delimited in a manner so as to be located substantially vertically when the stretcher is carried by said hand grips, and is arranged so that said stiffening elements are held with their cross-sections on edge when the stretcher is lifted, wherein said stiffening elements are divided lengthwise into sections which are arranged to overlap with their ends in their respective channels, so that stiffness against bending is maintained in spite of being divided into sections when the elements are kept on their edges in their respective channel.

2. The stretcher according to claim 1, wherein said middle portion of the sheet is adapted so that its width approximately corresponds to the width of a body plus two times half of the body thickness of persons, who are primarily intended to be carried by means of the stretcher.

3. The stretcher according to claim 1, wherein each of the channels is formed by a groove in the sheet, which groove is covered with bands attached to the surface of the body.

4. The stretcher according to claim 3, wherein the sheet is of a cellular material having at least one side provided with a harder surface layer, and wherein the grooves extend substantially through the whole cellular material up to the harder surface layer.

* * * * *